US005368189A

United States Patent [19]

Griffith

[11] Patent Number: 5,368,189

[45] Date of Patent: Nov. 29, 1994

[54] VENDING MACHINE FOR NEWSPAPERS AND LIKE ARTICLES

[76] Inventor: John Griffith, 320 Cricket Lake Dr., Naples, Fla. 33960

[21] Appl. No.: 230,256

[22] Filed: Apr. 20, 1994

[51] Int. Cl.[5] ..... G07F 11/06

[52] U.S. Cl. ..... 221/90; 221/195

[58] Field of Search ..... 221/81, 82, 84, 85, 221/90, 91, 195, 194, 196, 272, 273

[56] References Cited

U.S. PATENT DOCUMENTS

| | | | |
|---|---|---|---|
| 3,946,846 | 3/1976 | Pepiciello et al. | 221/90 |
| 4,506,800 | 3/1985 | Wingate | 221/194 |
| 4,667,803 | 5/1987 | Gordon | 221/195 |

*Primary Examiner*—Kenneth W. Noland
*Attorney, Agent, or Firm*—William F. Hamrock

[57] ABSTRACT

The present invention is to provide a newspaper vending machine which dispenses a single newspaper one at a time while protecting the remaining newspapers from pilferage and the elements. The vending machine includes a plurality of sequentially fixed rectangular slots to each support a newspaper. A releasable bottom door has a side extension attached to each slot. When a pull lever is outwardly pulled, the bottom door is forced open by a trip lever which pushes against a trip rod causing a newspaper to slide out of the slot and onto a slide bar. The newspaper then slides to the front of the vending machine where it is picked up by the purchaser. Specifically, a trip lever engaging device includes a pull hook which pulls a pull belt to cause the pull lever to engage a peripheral flange and thereby cause the bottom door of the newspaper slot to open and the newspaper to drop down.

16 Claims, 7 Drawing Sheets

VENDING MACHINE FOR NEWSPAPERS AND LIKE ARTICLES

BACKGROUND OF THE INVENTION

1. Field of the Invention

The invention relates to a vending machine for newspapers and like articles and more particularly, to a coin operated machine in which the newspapers and like articles are dispensed individually from an upstanding position.

2. Description of the Prior Art

Most newspaper vending machines expose a stack of newspapers to the purchaser upon inserting coins and opening the door. These machines although in general use do create problems with pilferage along with exposing the stack of newspapers to the elements which becomes a serious problem in many areas depending upon many factors. Other vending machines have been designed to dispense single newspapers but many of these machines have not been accepted for various reasons such as not being practical or as being complicated devices making them expensive to operate and to maintain.

There is a need for a coin operated vending machine which will dispense a single newspaper or a like article one at a time without exposing the remaining articles to possible theft or to the elements.

SUMMARY OF THE INVENTION

An object of the present invention is to provide a newspaper or similar article coin operated vending machine which dispenses a single newspaper or similar article at one a time while protecting the remaining newspapers from pilferage and the elements.

It is another object of the invention to provide such a machine which is mechanically reliable and easy to refill with newspapers and to maintain.

It is a further object of the invention to provide the purchaser with a newspaper vending machine which is easy to operate while dispensing only a single newspaper at a time.

The present invention defines a coin operated vending machine for dispensing a single newspaper or similar article (which hereafter will be referred to as a newspaper). The vending machine which can be constructed of metal or plastic includes an exterior cabinet having a coin box and pull lever mounted on a front panel. The coin box activates the system and the pull lever activates the interior mechanism which leads to dispensing a single newspaper. The interior mechanism which is enclosed within the exterior cabinet includes a plurality of sequentially fixed rectangular newspaper slots, each slot supporting a newspaper in an upright position. A releasable bottom door having a side extension is attached to each slot. When the pull lever is pulled outwardly, the bottom door is forced open by a trip lever engaging means which pushes against the trip rod causing the newspaper to slide out of the slot onto a slide bar. The newspaper slides to the front of the vending machine where it is easily picked up by the purchaser.

The trip lever engaging means is attached to a trip lever mechanism which slides along guide tracks adjacent to the newspaper slots causing the trip lever to engage the peripheral flange. The trip lever mechanism forward movement is controlled by the forward movement of a pull belt connected thereto. When the pull lever is moved outwardly after inserting coins into the coin box, the pull lever operates a pull joint bar flexibly connected to a pull hook. The pull hook in turn pulls the pull belt and trip lever mechanism forward causing the pull lever to engage the peripheral flange and to open the bottom door of the newspaper slot allowing the newspaper to drop down. The procedure of dispensing a single newspaper from the machine is referred to herein as a dispensing cycle.

BRIEF DESCRIPTION OF THE DRAWINGS

Although such novel features believed to be characteristic of the invention are pointed out in the claims, the invention and the manner in which it may be carried out may be further understood by reference to the following disclosure and to the accompanying drawings.

DETAILED DESCRIPTION

Figure 1:
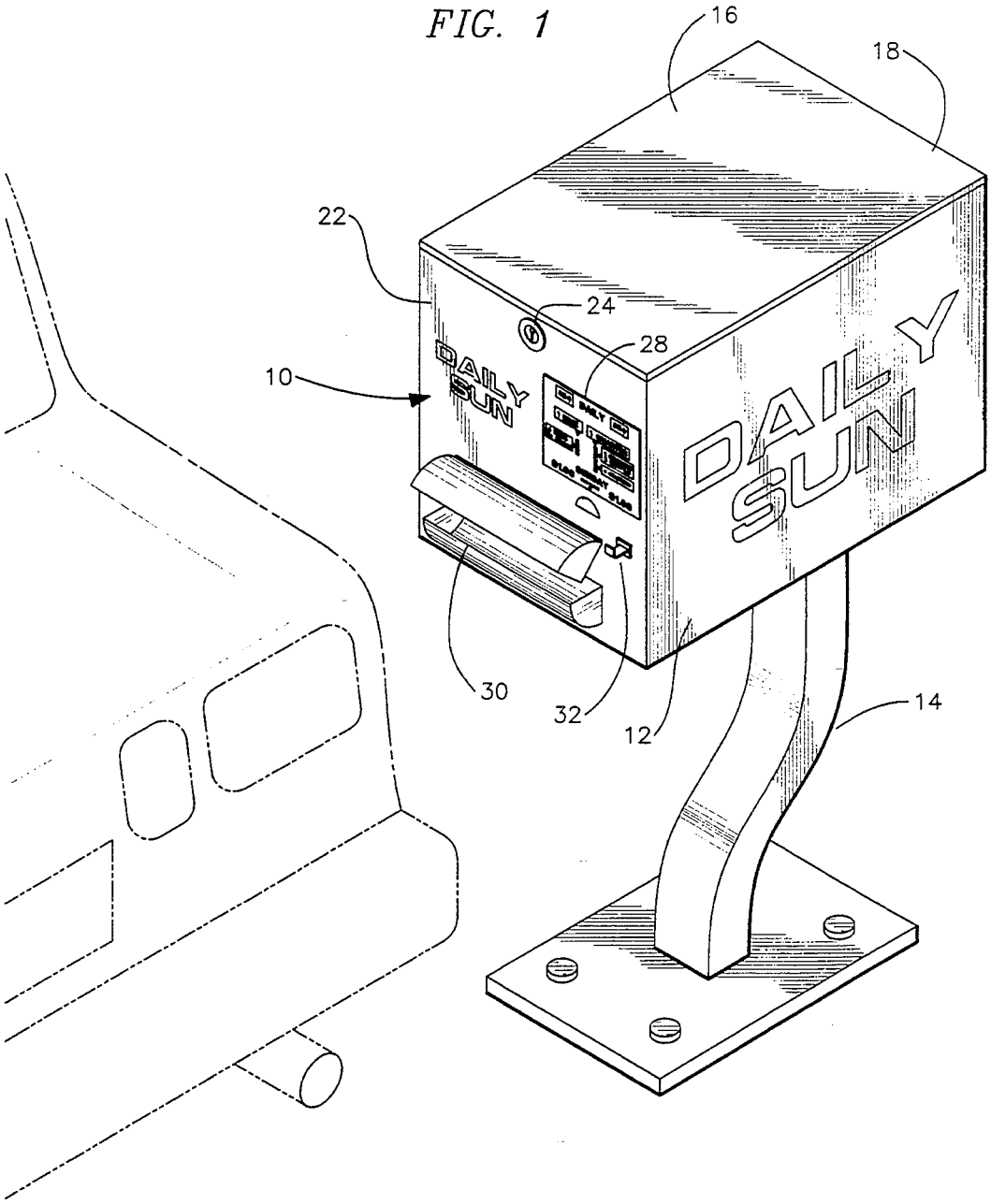
FIG. 1 is a perspective view of the exterior of the newspaper vending machine.

Referring to the drawings in detail and the numerals of reference therein, there is shown in FIG. 1 an exterior view of the vending machine 10 of the invention for dispensing a single newspaper at a time. An outer rectangular cabinet 12 is shown seated upright on support stand 14 which represents any standard newspaper support stand. The cabinet includes top cover 16 shown seated on front panel 22, rear panel 18 and side panels. Top cover 16 can be hingedly secured to either front or rear panels enabling it to be raised to an upright position to allow depositing newspapers 20 into the machine. Front panel 22 is provided with locking mechanism 24 permitting top cover 16 to be locked in a secured position. Other elements on the front panel 22 include a information plate 28, newspaper exit opening 30 and pull lever 32 attached to the front panel 22 as seen in FIG. 1 and to a standard coin box. A clear window may be enclosed within the front panel to allow viewing the presence of the forwardmost newspaper within the machine.

Figure 2:
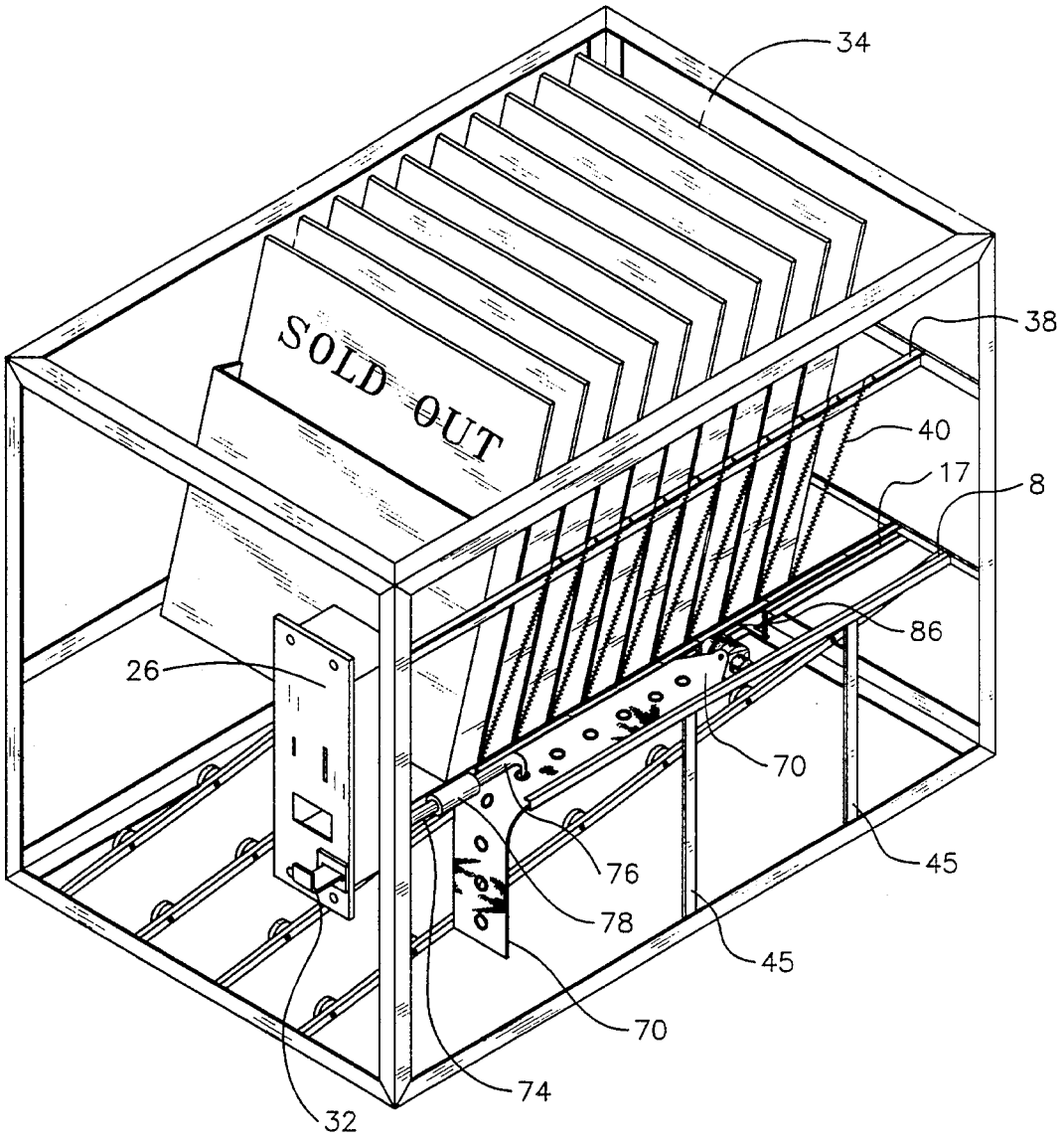
FIG. 2 is a perspective view of the interior cabinet mechanism.
Figure 7:
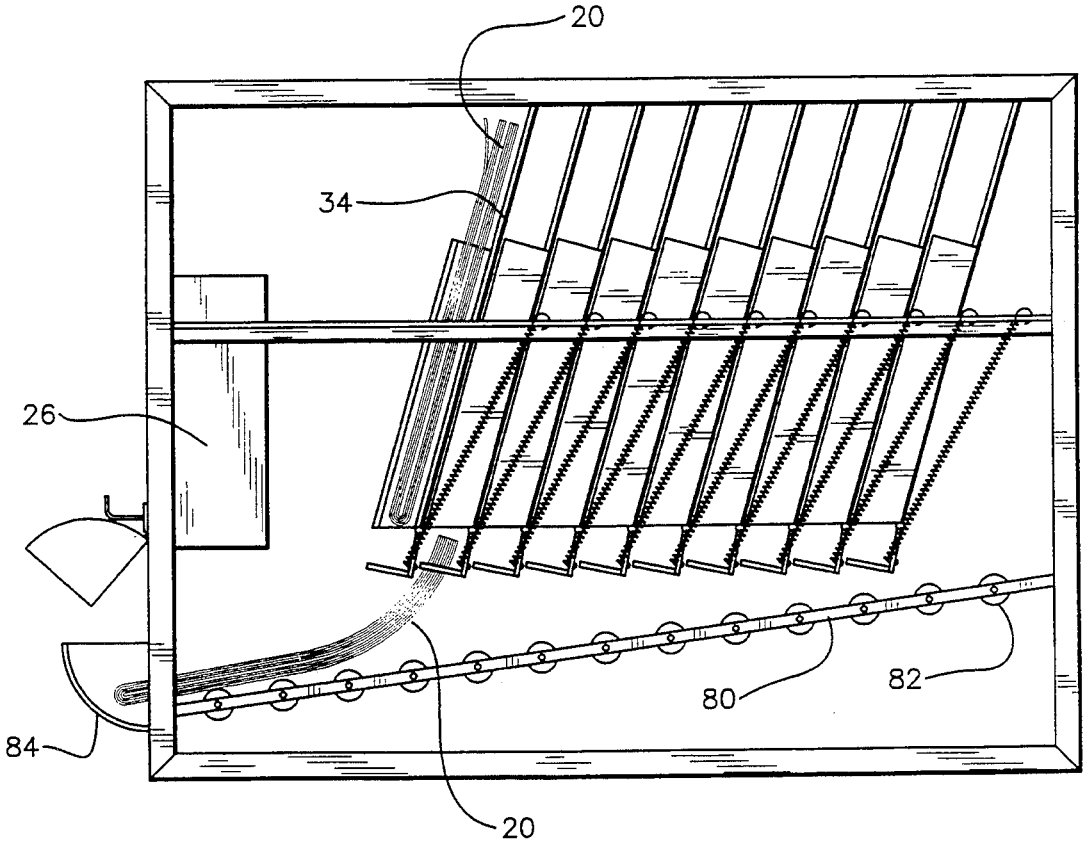
FIG. 7 is a sectional side view depicting a newspaper having been released from a newspaper slot.

The mechanism for operating the machine is shown in the interior view the frame in FIG. 2 after the exterior panels have been removed. Extending from the front to the back are a plurality of sequentially fixed rectangular adjoining sectional newspaper slots 34 having front and back panel sections and a releasable flat bottom trip door 36 seen in FIG. 5. Each of the individual newspaper slots is inclined at a slight angle and made large enough to support a single newspaper in an upright position having the newspaper folded end at the bottom as shown in FIG. 7. The front section of the front slot may extend only part way up allowing viewing of the newspaper in the front slot through a window on front panel 16.

Figure 3:
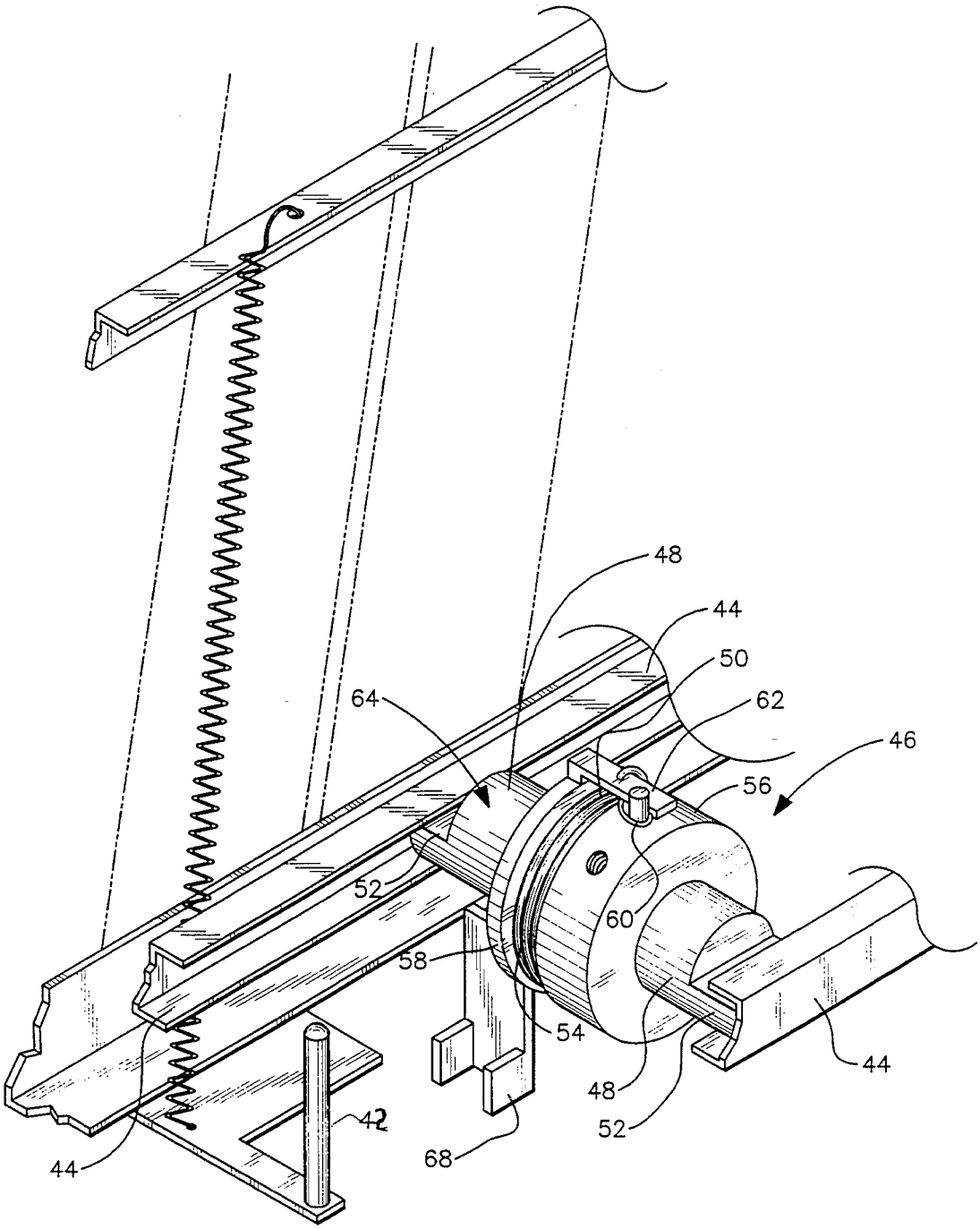
FIG. 3 is a perspective sectional view of the trip lever mechanism with the bottom door of the newspaper slot in the closed position.

Spring retainer rod 38 shown extending from the front to the rear of the frame is attached to the upper right side of the newspaper slots 34 and runs adjacent to the upper portions of slots. A plurality of door springs 40 are attached to the spring retainer with each door spring diagonally anchored to a bottom trip door 36 exerting upward pressure thereon thus forcing the door to a closed position as seen in FIG. 3. Each trip door includes a peripheral flange 42 extending upwardly from the right side extension thereof when the trip door is in the closed position as seen in FIG. 3. All flanges are spaced apart the same distance from each other coinciding with the spacing of the newspaper slots from each other.

Adjacent to the lower portion of newspaper slots 34 are stationary rear to front C-shaped guide tracks 44 which support the forward and backward movement of the trip lever mechanism 48 and pull belt 70. The guide tracks 44 consist of spaced apart parallel tracks extending the length of the newspaper slots and are supported by track supports 45.

Figure 4:
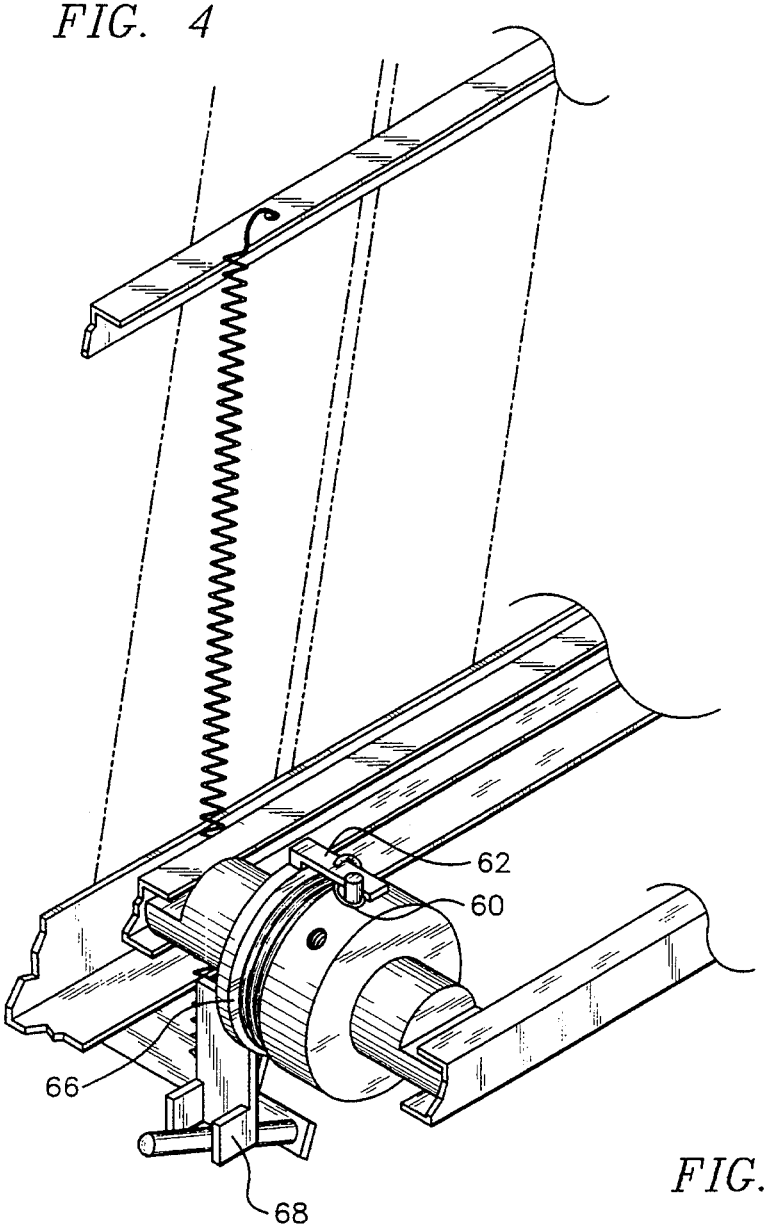
FIG. 4 is a perspective sectional view of the trip lever engaging the peripheral flange with the bottom door in an open position.

The trip lever mechanism 46 embodies a horizontal support axle 48 and a spring operated linkage 50 mounted thereon. Support axle 48 includes flat rectangular end sections 52 which fit into and slide along guide tracks 44 as seen in FIG. 3 which allows the trip lever mechanism to move in the forward direction and in the rearward direction on the guide tracks. Spring operated linkage 50 includes a spool mounted spring 54 sandwiched between exterior collar support 56 and interior collar support 58 on the center section of horizontal support axle 48 wherein the outer end of the spring is secured to fixed peg 60 and the opposite inner end of the spring is secured to horizontal stationary arm 62 of trip lever unit 64. The trip lever unit 64 as seen in FIGS. 3 and 4 includes a disc body element 66 rotatably mounted on axle 48 with its horizontal arm 62 extending from its upper section wedged against fixed peg 60 and its trip lever 68 descending from its lower section directly below arm 62. When trip lever unit 64 within trip lever mechanism 46 is moved along the guide tracks 44 towards the front of the vending machine, horizontal arm 62 since it is being wedged against peg 60 is prevented from moving forward but moves only rearward and thus disc element 66 and trip lever 68 are prevented from moving in a rearward direction but allows their movement in the forward direction.

Figure 6:
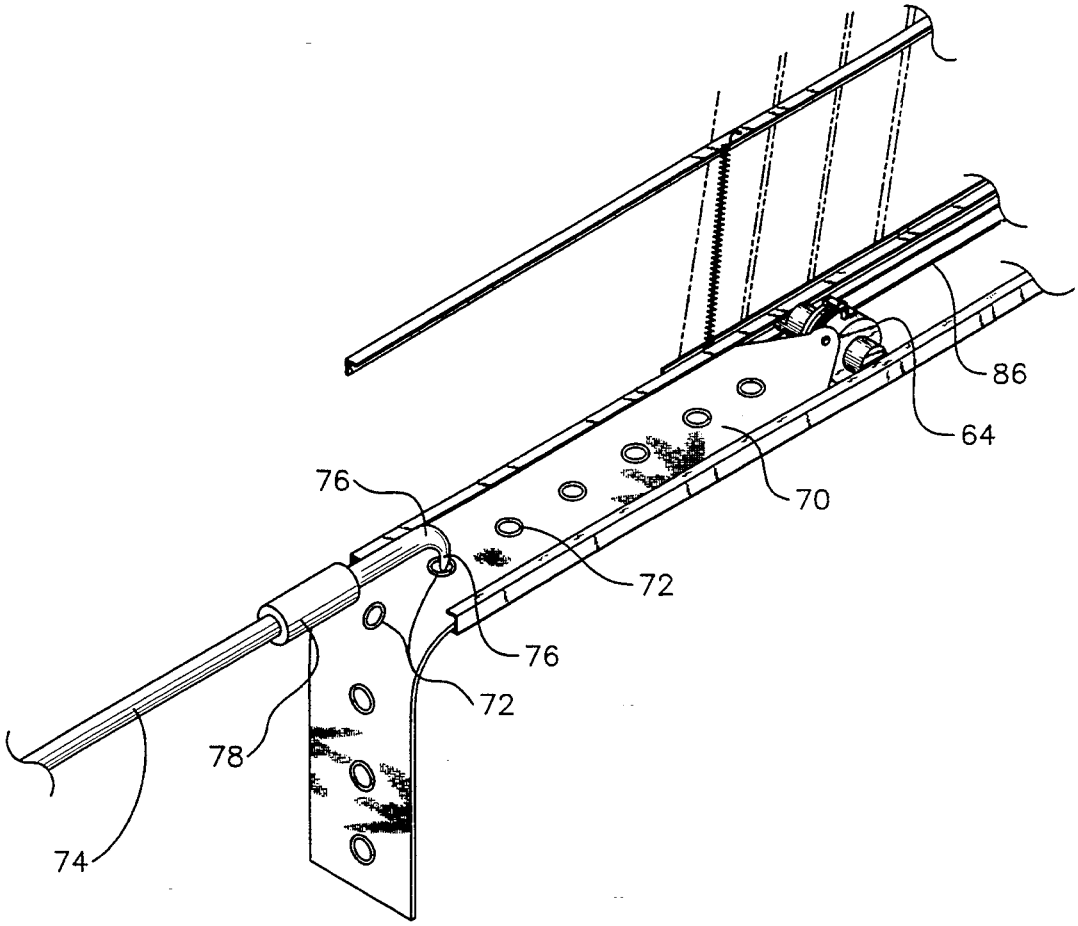
FIG. 6 is a perspective sectional view of the pull belt, trip lever mechanism and pull hook.

As seen in FIGS. 2 and 6, pull belt 70 is secured to trip lever unit 64 and thereby controls the forward movement of the trip lever unit by pulling it forward. Pull belt 70 is made of a durable fabric or metal sheet material, such as nylon or strip metal. It slides within guide tracks 46 overlapping the front end of the tracks and has a plurality of central holes 72 extending its entire length. Holes 72 are spaced apart about the same distance as the distance that separates the peripheral flanges 42 from each other and the belt may be protected by metal eyelets as required at the hole area. Pull joint bar 74 is attached to pull lever 32 associated with the coin box and is coupled with pull hook 76 shown fitted within a hole 72. Pull hook 76 is releasably attached to pull joint bar 74 by flexible connector 78 which allows the pull hook to be replaced as required and also to allow the hook to have flexible movement. The pull hook is fabricated of a strong flexible material, such as nylon, resilient plastic or a resilient metal or similar material, which makes it resiliently rigidly durable to fit securely within the holes to move the pull belt forward and also to be capable of moving along the surface of the pull belt to fit within a central hole at the completion of the dispensing cycle.

When the machine is activated by insertion of coins in the coin box, the pull lever is then pulled out by the purchaser which pulls the pull joint bar 74 and replaceable pull hook 76 forward causing pull belt 70 to be moved forward the distance equal to the distance between the holes causing the front end of the pull belt to hang down as seen in FIGS. 2 and 6. This movement, in turn, causes the belt within the guide tracks to move forward pulling trip lever mechanism 46 forward sliding within the guide tracks the distance equal to the distance between each individual newspaper slot 34.

Figure 5:
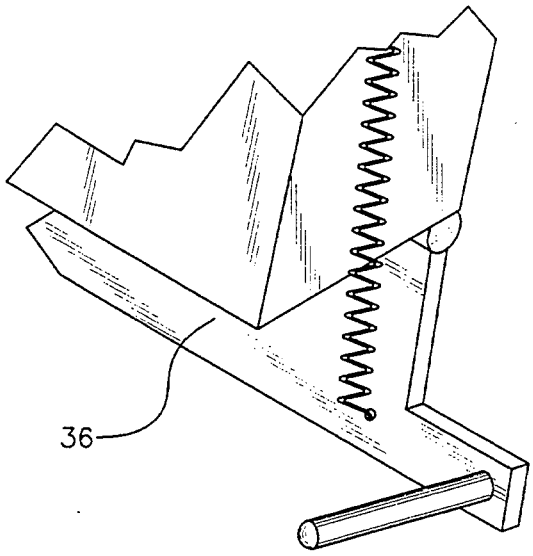
FIG. 5 is a perspective sectional blow-up view of the bottom door in the open position.

As seen in FIGS. 3, 4 and 6, the forward movement of trip lever mechanism 46 causes trip lever 68 to engage peripheral door flange 42. This forces the engaged flange and trip door downward thus opening the trip door as seen in FIGS. 4 and 5. The newspaper within that slot is dispensed therefrom by dropping down onto the newspaper slide bar 80 and rollers 82 as seen in FIG. 7.

Shown also in FIG. 7 is a side view of the newspaper slots 34 newspaper slide bar 80 and rollers 82. Slide bar 80 extends from the rear to the front of the machine in a slanting downward direction which allows the newspaper to slide forward. A plurality of rollers 82 are secured to the slide bar which enhances forward movement of the newspaper.

Aligned with the front end of the slide bar as shown in FIG. 7 is newspaper stop 84 which is fixed to the area of outer cabinet 12. The newspaper stop projects in a steep upward direction which stops the forward movement of the newspaper sliding along the slide bar. The newspaper stop prevents the newspaper from falling out of the machine and allows it to be retrieved by the purchaser.

Figure 8:
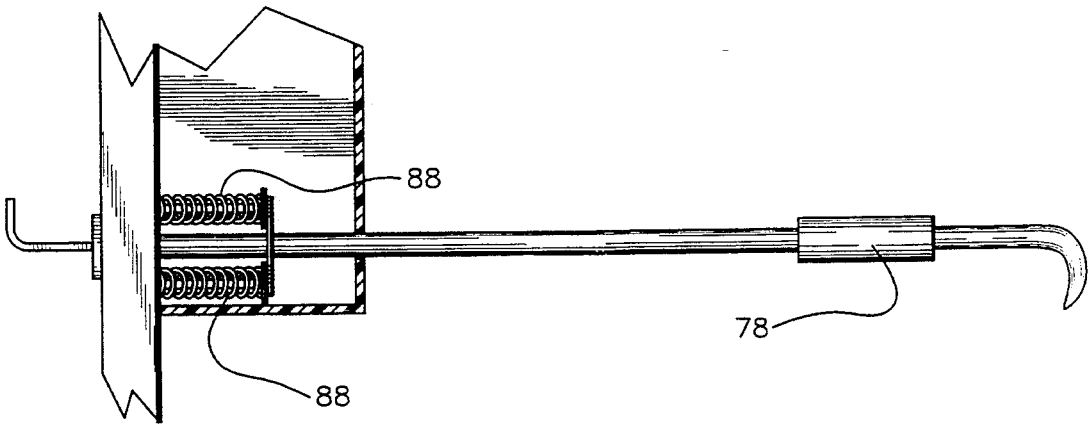
FIG. 8 is a sectional view of the pull lever.

When the purchaser releases the pull lever after activating the mechanism for obtaining the newspaper, springs 88 attached to the pull lever, as seen in FIG. 8, force the pull joint bar 74 and pull hook 76 rearward. The joint bar and pull hook travel the same return distance from which they had been pulled forward. Flexible connector 78 allows pull lever hook 76 to slide back along the top surface of the belt which allows the pull hook to drop into the next succeeding hole in the pull belt. The machine is now in position to dispense the next succeeding newspaper.

When the vending machine is refilled with newspapers after unlocking and opening top cover 16, the pull hook is removed from its position within the hole, then return handle 86 is used to return pull belt 70 and trip lever mechanism 46 and trip lever unit 64 to the initial starting position adjacent the furthermost newspaper slot 34 in the rear of the vending machine.

Having now described the invention, it will be apparent to one of ordinary skill in the art that many changes and modifications can be made thereto without departing from the spirit and scope of the invention as set forth herein.

PARTS LIST

10 vending machine
12 outer cabinet
14 vending machine support
16 top cover 18 rear panel
20 newspapers
22 front panel
24 locking mechanism
26 coin box means
28 information plate
30 exit opening
32 pull lever
34 newspaper slot
36 trip door
38 spring retainer rail (FIG. 3)
40 door spring
42 trip rod
44 guide track
45 track support means
46 trip lever mechanism
48 support axle
50 spring operated linkage
52 flat end section
54 spool mounted spring
56 exterior collar support means for trip lever mechanism
58 interior collar support means for trip lever mechanism
60 fixed peg
62 stationary arm
64 trip lever unit
66 disc body element
68 trip lever
70 pull belt
72 central holes
74 pull joint bar
76 replaceable pull hook
78 connector
80 slide bar
82 roller
84 stop
86 return handle
88 pull lever spring

What is claimed is:

1. A vending machine for dispensing a single newspaper or similar article during each dispensing cycle which dispenses a single newspaper comprising, a cabinet housing having a coin box capable of activating each dispensing cycle by inserting coins therein and a pull lever means capable of initiating each dispensing cycle when moved outwardly, support means mounted within the cabinet and arranged to hold a plurality of sequentially aligned fixed slot means extending from the rear to the front of the cabinet, each slot means having front and rear upstanding opposing panel means and a releasable bottom trip door means, each slot means capable of holding a newspaper in an upright position, each bottom trip door means having a spring means biasing the trip door means upwardly to a closed position and a side arm extension means equally spaced apart from other side arm extensions, guide track means mounted adjacent to the fixed slot means above the side arm extension means of the trip door means, a trip lever mechanism slidably mounted on the guide track means capable of moving in a forward and rearward direction thereon, the trip lever arm mechanism having a trip lever arm means descendingly mounted thereon and engagingly aligned with the side arm extension means of the trip door means so as to engage a side arm means and push open the trip door means upon forward movement of the trip lever mechanism during each dispensing cycle, a pull belt means slidably mounted on the guide track means and capable of moving in a forward or rearward direction thereon, the pull belt means having a front end and a rear end with the rear end fixed to the trip lever mechanism and the front end unattached, the pull belt means having a plurality of equally spaced central holes extending over the length of the pull belt means, a pull hook means having a horizontal pull arm means internally secured to the pull lever means at the front of the vending machine and a hook end means releasably secured within one of the central holes of the pull belt means, whereby the pull lever means is capable of initiating the dispensing cycle by being moved outwardly thereby moving the pull hook means forward which in turn moves the pull belt means and trip lever mechanism forward within the track means a cycle distance causing the trip lever arm means to engage the side arm extension means pushing it downwardly and opening the trip door means to allow a newspaper to slide out of the fixed slot means, whereby the pull lever means is then released and is capable of retracting back to its original position and moving the pull hook means rearward one cycle distance where the hook end means is capable of being securely inserted within the next succeeding hole.

2. A vending machine according to claim 1 wherein opposing panel means of the fixed slots are set at an angle to allow the newspaper to be supported resting in an upright position.

3. A vending machine according to claim 2 wherein the opposing panel means are rectangular panels.

4. A vending machine according to claim 1 wherein the spring means biasing the trip door means to a closed position are individual spring attachments each diagonally suspended downwardly from above each fixed slots to each trip door means.

5. A vending machine according to claim 4 wherein the spring attachments are suspended from a horizontal rod means adjacent to the side of the fixed slots.

6. A vending machine according to claim 1 wherein each side arm extension means provides a fixed flange extending upwardly when its trip door means is in the closed position wherein all flanges are equally spaced apart to be capable of engaging the trip lever arm means and open the trip door means during a dispensing cycle.

7. A vending machine according to claim 6 wherein the trip lever mechanism provides a horizontal support axle means which is capable of moving along the track means.

8. A vending machine according to claim 7 wherein the trip lever mechanism provides a spring operated linkage means mounted on the axle means.

9. A vending machine according to claim 8 wherein the spring operated linkage means provides the trip lever arm means descending therefrom being rigidly mounted thereon when moving in the forward direction by means of a stop means which interrupts the spring operation.

10. A vending machine according to claim 9 wherein the rigidly mounted forward moving trip lever arm means is capable of engaging each flange means to open the trip door means when the trip lever mechanism moves in the forward direction during a dispensing cycle.

11. A vending machine according to claim 10 wherein the trip lever arm means is resiliency mounted by the effective spring operation when moving in the rearward direction.

12. A vending machine according to claim 11 wherein the resiliency mounted rearward moving trip lever arm means is capable of sliding over an engaging flange means when moving in the rearward direction.

13. A vending machine according to claim 1 wherein the horizontal pull arm means provides a pull joint bar means joined to the replaceable pull hook means by a releasable flexible connector means.

14. A vending machine according to claim 13 wherein the pull lever means is mounted on a spring operated system which is capable of returning the pull lever means to its original inactivated position after releasing the pull lever means.

15. A vending machine according to claim 14 wherein the newspaper is capable of being dispensed by sliding from the slot means onto a plurality of downwardly slanted roller means to the front of the machine.

16. A vending machine according to claim 1 wherein a return handle means is capable of moving the trip lever mechanism and belt means to the rear of the machine.

* * * * *